US007258511B1

(12) United States Patent
Cerda

(10) Patent No.: US 7,258,511 B1
(45) Date of Patent: Aug. 21, 2007

(54) SHORING SYSTEM

(75) Inventor: Victor M. Cerda, Houston, TX (US)

(73) Assignee: Cerda Industries, Inc., Houston, TX (US)

( * ) Notice: Subject to any disclaimer, the term of this patent is extended or adjusted under 35 U.S.C. 154(b) by 16 days.

(21) Appl. No.: 11/530,974

(22) Filed: Sep. 12, 2006

(51) Int. Cl.
*E02D 17/04* (2006.01)

(52) U.S. Cl. ..... 405/282; 405/272; 405/283

(58) Field of Classification Search ..... 405/272, 405/282, 283
See application file for complete search history.

(56) References Cited

U.S. PATENT DOCUMENTS 5,096,334 A * 3/1992 Plank ..... 405/283
5,209,606 A * 5/1993 Plank ..... 405/303
5,232,312 A * 8/1993 Jennings et al. ..... 405/282

* cited by examiner

*Primary Examiner*—Frederick L. Lagman
(74) *Attorney, Agent, or Firm*—Streets & Steele; Patrick K. Steele

(57) ABSTRACT

Improved shoring systems and methods are disclosed. In one embodiment, a shoring system includes first and second opposing side walls. A manifold is pivotally connected to the first side wall and is pivotally moveable between a shielded position and an exposed position. In the shielded position, the manifold is at least partially covered by a shield. In the exposed position, the manifold is pivoted upward to expose components of the manifold, such as hydraulic inlets and outlets, valves, and hydraulic fluid lines. The shoring system is safer, easier, and more efficient to operate than conventional shoring systems.

16 Claims, 6 Drawing Sheets

SHORING SYSTEM

BACKGROUND OF THE INVENTION

1. Field of the Invention

The present invention relates to shoring systems for supporting the sides of an excavation to prevent cave-ins.

2. Description of the Related Art

Shoring systems are used to "shore" (support) the earthen walls of an excavation to help prevent cave-in around workers. A shoring system typically includes a pair of opposing side walls driven forcibly outward by hydraulic actuators against earthen walls of the excavation. Shoring therefore protects workers doing work in the excavation, such as below ground repairs, maintenance, or installations such as laying a pipeline. Excavations may be deep and the soil in and surrounding the excavation may be unstable, which poses a risk to workers. Therefore, it is important to use a reliable shoring system capable of withstanding the large pressures that can be exerted by earthen walls. It is also important to use a shoring system that can be easily controlled, such as to drive the side walls outward and maintain pressure against the earthen walls of the excavation. It is critical for a shoring system to be easily controllable in case of an emergency, as well as for efficiently inserting and subsequently removing the shoring system from the excavation.

FIG. 1 shows a conventional shoring system 1, having a pair of spaced-apart side walls 2 each equipped with an upper cap 8 and lower skid 9. A pair of supporting rails 3, also known in the art as wales, are mounted in parallel along the inner faces of each side wall 2. The side walls 2 are connected by telescoping cross members, 4*a*, 4*b* The ends of the cross members 4*a*, 4*b* are mounted in channels defined by opposing wales 3. A hydraulic jack or cylinder 10 is mounted proximate each cross member, and the ends of each hydraulic jack are also mounted, via respective pads, in the channels of the opposing wales 3. The hydraulic jacks operate to expand or contract the space between the side walls 2, and provide compressive preloading of the walls of an excavation to prevent or at least reduce the likelihood of a cave-in. A coiled steel closure spring 7 helps draw together the side walls 2, during removal of the assembly 1 from an excavation. The hydraulic jacks 10 distribute hydraulic fluid pressure to the hydraulic jacks 10 by way of a stationary manifold assembly 21. The manifold assembly 21 may include a bored, block manifold body (not shown) secured to a side wall 2, some valves and other fluid control devices, and a shield 28 bolted to the block manifold body. Hydraulic lines 41 are routed from the manifold assembly 21 to the jacks 10 by way of a channel in one of the wales 3.

The configuration of the conventional manifold 21 limits a user's ability to access the block manifold body, such as to connect and disconnect hoses or to control the supply of hydraulic fluid to the hydraulic jacks. The user's ability to quickly and easily control the movement of the side walls 2 is thereby limited. In the even of an emergency, a user may be unable to access the manifold to control the side walls 2. Even under normal operating conditions, the lack of access a user has to the manifold reduces the efficiency by which the conventional shoring system 1 may be operated. Therefore, an improved shoring system is needed for faster, safer, more reliable, and more convenient operation by a user.

SUMMARY OF THE INVENTION

The present invention includes improved shoring systems and methods. In one embodiment, a shoring system includes first and second opposing side walls. A plurality of hydraulic jacks are connected between the side walls for selectively adjusting a spacing between the side walls. A manifold includes a hydraulic inlet for receiving hydraulic fluid from a fluid source and a plurality of hydraulic outlets for distributing the hydraulic fluid to the plurality of hydraulic jacks. The manifold is pivotally secured to the first side wall and pivotally moveable between a shielded position and an exposed position. A manifold shield is disposed on the manifold for shielding the manifold when the manifold is in the shielded position.

In a second embodiment, a shoring system includes first and second opposing side walls. A plurality of hydraulic jacks are connected between the side walls for adjusting the relative spacing between the side walls. A pair of rails connected in parallel across an inner face of each of the opposing side walls. A plurality of first pads are carried in each of the rails of the first side wall and a plurality of second pads are carried in each of the rails of the second side wall. The plurality of hydraulic jacks are each operatively connected between one of the first pads and one of the second pads. A manifold has a hydraulic inlet for receiving hydraulic fluid and a plurality of hydraulic outlets for distributing hydraulic fluid to the plurality of hydraulic jacks. A manifold shield is pivotally secured to the first side wall for carrying the manifold between a shielded position wherein the manifold is covered by the shield, and an exposed position wherein the manifold is exposed.

In a third embodiment, a method of shoring is provided. A manifold secured to a first side wall is exposed by pivoting the manifold from a shielded position, wherein the manifold is shielded, to an exposed position, wherein manifold is accessible to a user. Fluid flow through the manifold is controlled to actuate a plurality of hydraulic jacks connected between the first side wall and an opposing second side wall, to adjust a spacing between the first and second side walls. The manifold is shielded by pivoting the manifold from the exposed position back to the shielded position.

DETAILED DESCRIPTION OF PREFERRED EMBODIMENTS

The present invention includes shoring systems and shoring methods providing a greater measure of control and safety than with conventional shoring systems and methods. According to one embodiment of the present invention, a manifold for controlling a hydraulically operated shoring system is moveable between a shielded position and an exposed position. An operator can easily pivot the manifold to the exposed position to gain control of hydraulic controls, or to connect or disconnect the various hydraulic control lines. An operator can then pivot the manifold to a shielded position, wherein the manifold, the hydraulic controls, and the hydraulic connections are at least partially shielded and protected. The shielded position protects against inadvertent manipulation of the manifold during normal use, such as where workers are working in the excavation. While the workers are moving about within the confines of the shoring system walls, they are unlikely to bump any shielded controls to cause any sudden, unexpected movement of the side walls. Simultaneously, the workers have the option of gaining full or at least limited access to the hydraulic controls. For example, if there is a sudden pressure loss in the hydraulic cylinders, a worker may simply pivot the manifold to the exposed position to supply additional fluid pressure to the hydraulic actuators. Furthermore, workers may efficiently and reliably pivot the manifold to the exposed position during installation or removal of the shoring system in the excavation, to connect or disconnect hydraulic lines as needed. A shoring system according to the present invention is therefore safe, convenient, and efficient to operate.

Figure 1:
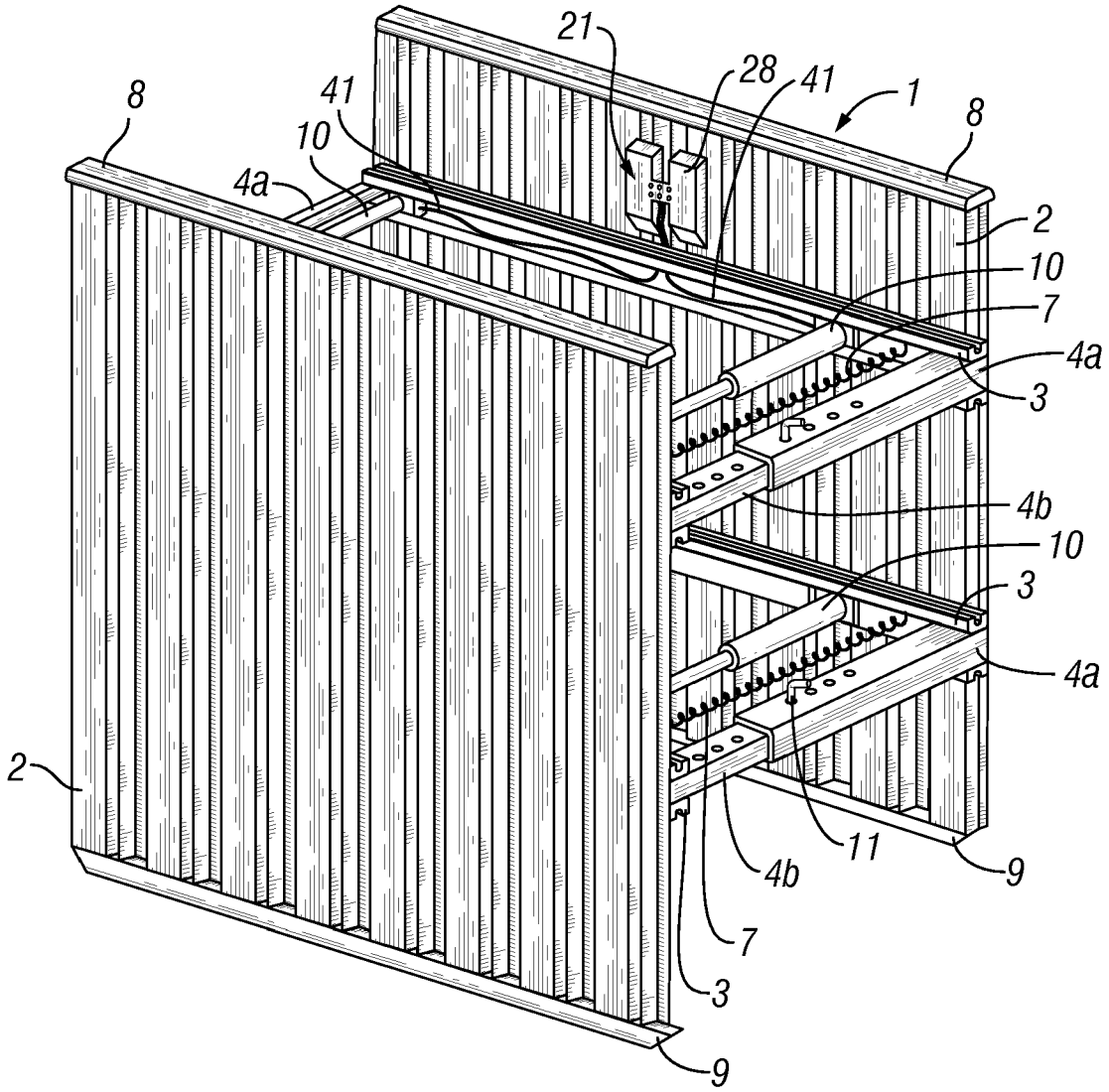
FIG. 1 (Prior Art)
FIG. 1 is a perspective view of a conventional shoring system having a fixed manifold assembly.
Figure 2:
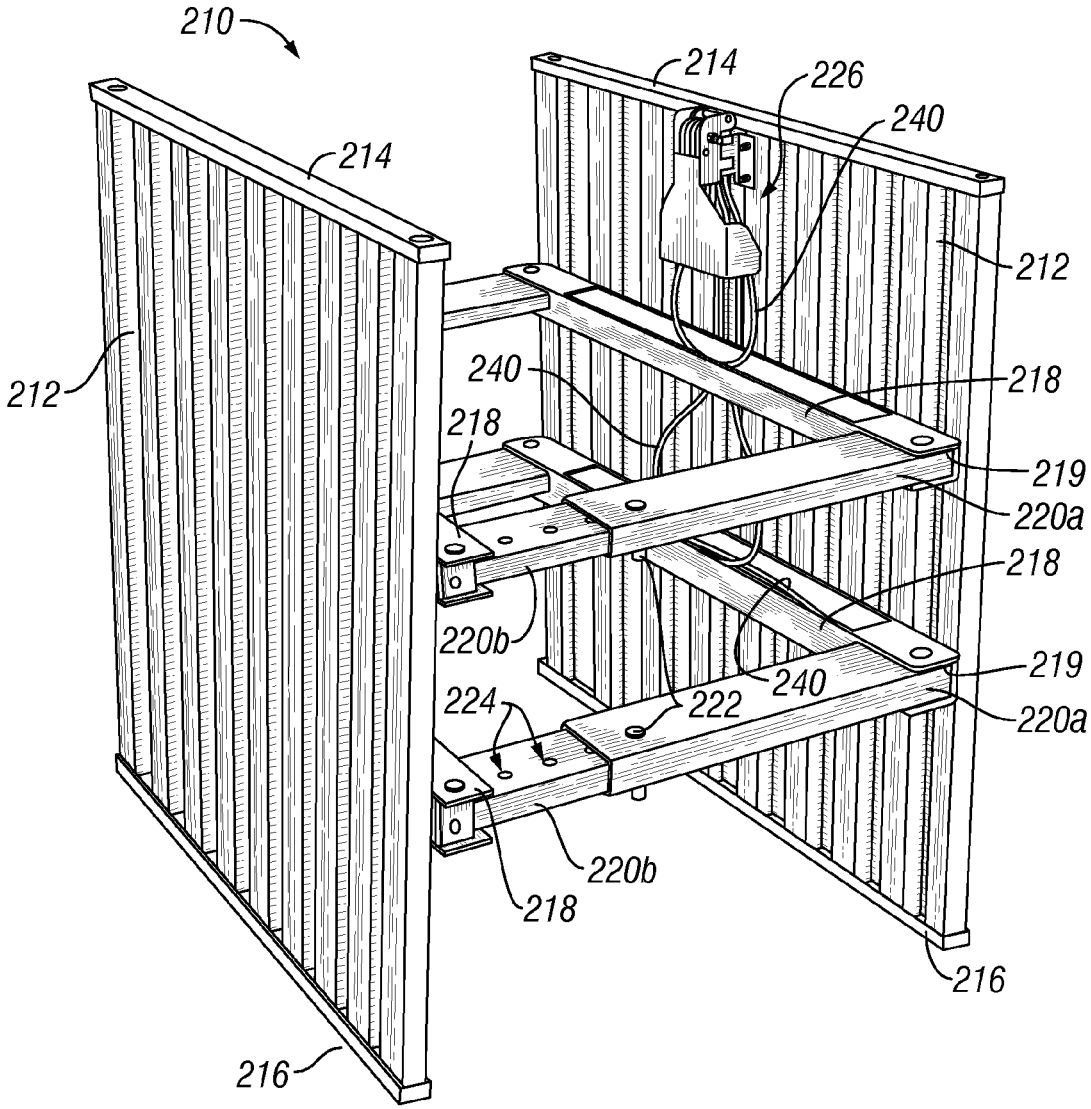
FIG. 2 is a perspective view of a shoring system having a pivotal manifold assembly according to the present invention.
Figure 3:
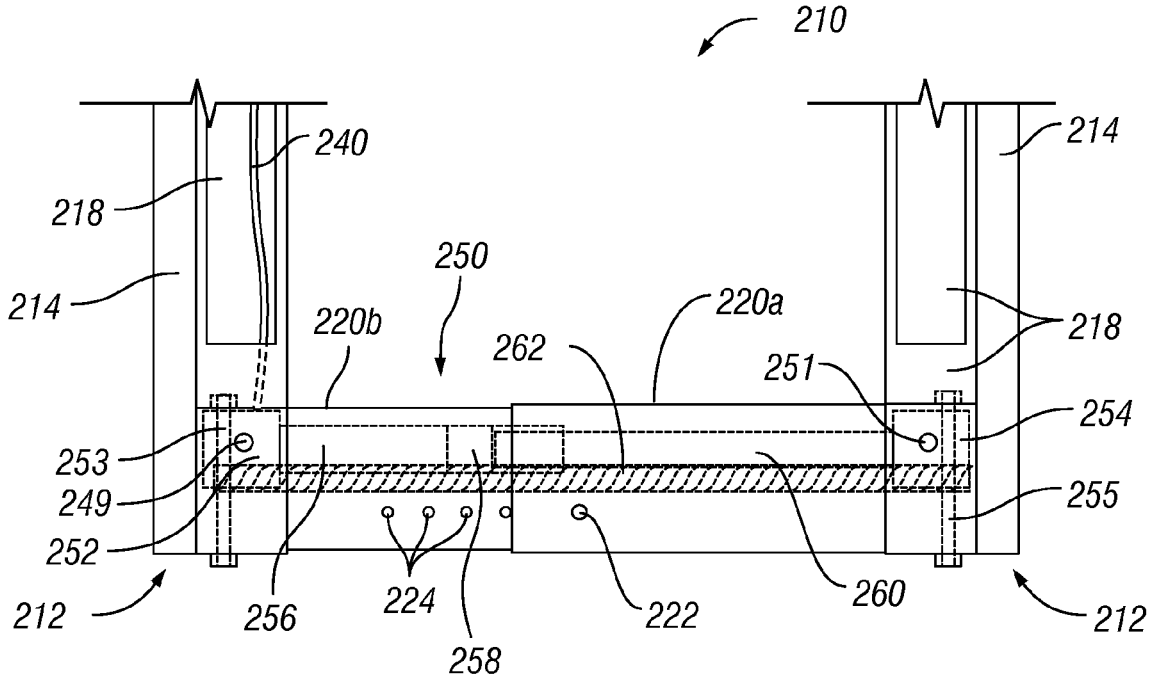
FIG. 3 is a side view of a hydraulic jack and a closure spring used with the shoring system of FIG. 2.

With reference first to FIGS. 2-3, the present invention provides a shoring system 210 for supporting the walls of an excavation, and preventing earth movement at or near the excavation—particularly cave-ins. The shoring system 210 comprises a pair of opposing side walls 212 composed of corrugated aluminum sheets, and reinforced at the ends thereof with bolted cap and skid elements 214, 216. The side walls 212 are further reinforced by a pair of supporting rails, or wales 218 bolted in parallel fashion across an inner face of each of the opposing side walls 212.

The side walls are connected in a box-like structure by telescoping rectangular steel-tubing cross-member sets, having telescoping component parts 220*a*, 220*b*. Adjustable static widths are determined by way of retaining bolts or pins 222 and spaced apart locking holes 224 in each cross member 220*b*. The ends of the cross member sets 220*a*, 220*b* are mounted in channels 219 (see FIG. 2) defined by opposing wales 218.

A hydraulic jack 250 is mounted within each cross member (see FIG. 3), and the ends of each hydraulic jack are also mounted, via respective pads 252, 254, in the channels 219 of the opposing wales 218. The hydraulic jacks 250 operate to expand (or contract) the space between the side walls 212, thereby enabling compressive preloading of the walls of an excavation to prevent or at least reduce the likelihood of a cave-in. More particularly, a plurality of first pads 252 are secured in the wales 218 of one side wall 212 (left side of FIG. 3) via bolts or pins 253 and corresponding transverse bores (not numbered) through the pads 252 and cross-members 220*b*. Similarly, a plurality of second pads 254 are carried in the wales 218 of the other side wall 212 (right side of FIG. 3) via bolts or pins 255 and corresponding transverse bores (not numbered) through the pads 254 and cross-members 220*a*. Accordingly, the plurality of hydraulic jacks 250 are each operatively connected between an opposing pair of first and second pads 252, 254.

Each of the hydraulic jacks 250 comprise a hydraulic cylinder 256 operatively connected, via a bolt or pin 249, to a first pad 252 of an opposing pair of first and second pads. A hydraulic piston 258 is disposed for axial movement within each hydraulic cylinder 256, and a piston rod 260 (and possibly complementing extensions and/or oversleeves, neither of which is shown) extends from each hydraulic piston 258 for transferring force to or from the hydraulic piston 258. The piston rod 260 is operatively connected, via a bolt or pin 251, to a second pad 254 of the opposing pair of first and second pads.

A plurality of coiled steel closure springs 262 are also mounted between the opposing wales 218, by way of engagement with the bolts or pins 253, 255 at the respective ends of the spring 262. Each spring 262 is positioned proximate a hydraulic jack 250 within a cross member set 220*a*, 220*b* for aiding in the contraction of the side wall spacing, and thus the removal of the shoring system 210 from an excavation.

The hydraulic jacks are operable under hydraulic fluid pressure delivered from a source (not shown) such as a hand pump or powered pump coupled to a reservoir of hydraulic fluid. The hydraulic fluid is distributed to the hydraulic jacks 250 by way of a movable manifold assembly 226 (see FIG. 2). With reference now to FIGS. 3-7, the manifold assembly 226 includes a cylindrical manifold body 228 and a manifold shield 230. The manifold body 228 is equipped with a hydraulic inlet for receiving hydraulic fluid and a plurality of hydraulic outlets for distributing hydraulic fluid to the plurality of hydraulic jacks 250. The hydraulic inlet of the manifold body 228 comprises a quick-connect coupling 234 and a shut-off inlet valve 232 for admitting and controlling the flow of hydraulic fluid into the manifold body. Similarly, each hydraulic outlet of the manifold body 228 comprises a shut-off outlet valve 236 and quick-connect coupling 238 for controlling and discharging the flow of hydraulic fluid from the manifold body to a hydraulic jack 250. A plurality of fluid lines or hydraulic hoses 240 are connected to the respective outlet valves 236, by way of the quick-connect couplings 238, for delivering hydraulic fluid from the manifold body 228 to the respective hydraulic jacks 250, via the pads 252, e.g., using a quick-connect coupling mounted to each pad 252.

The manifold shield 230 is pivotally mounted to an inner face of one of the side walls 212 using a bolt or pin 242 carried across a flanged portion 231 of the manifold shield. The bolt 242 is further carried across a flanged portion 244 of a bracket 246 bolted to the inner face of the one side wall. As shown in FIGS. 3-7, the flanged portion 244 is generally disposed within the flanged portion 231. The manifold shield 230 carries the manifold body 228 for pivotal movement between a lower position (shown in FIG. 4) wherein the manifold body is covered by the manifold shield, and one of two upper positions (shown in FIGS. 6-7) wherein the manifold body is exposed.

Figure 4:
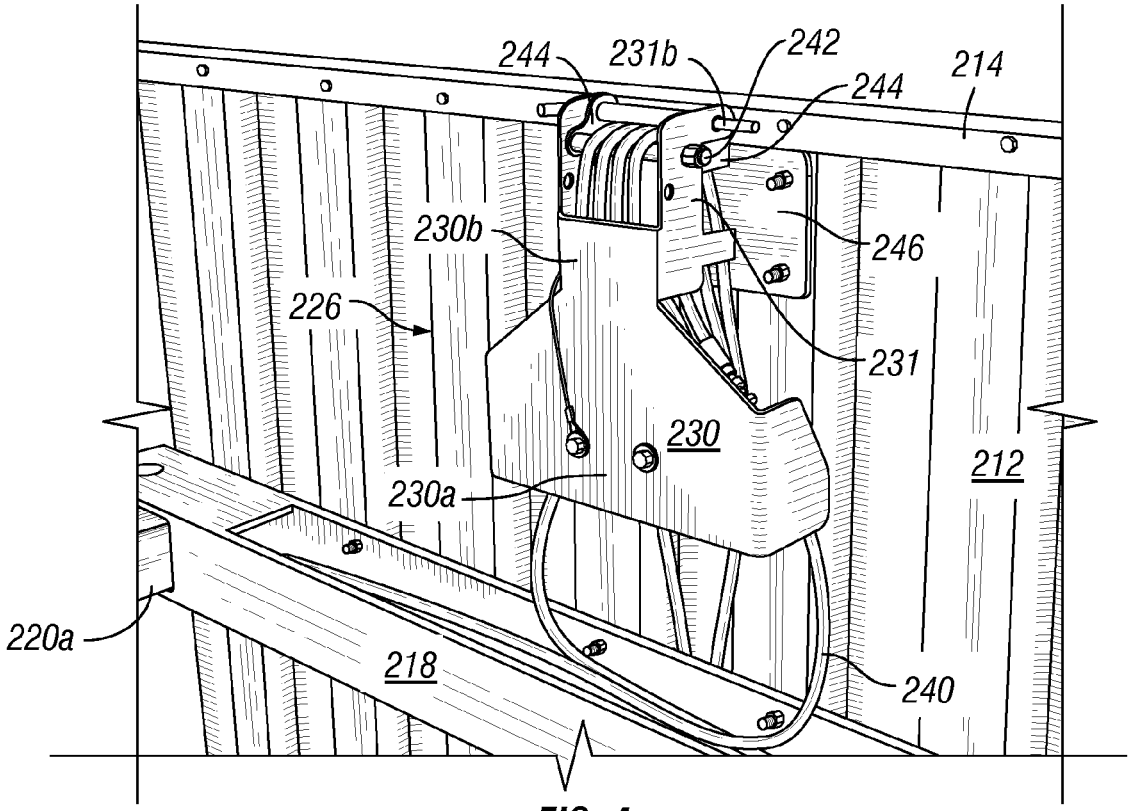
FIG. 4 is a detailed view of the manifold assembly of FIG. 2 in a lower, shielded position.
Figure 5:
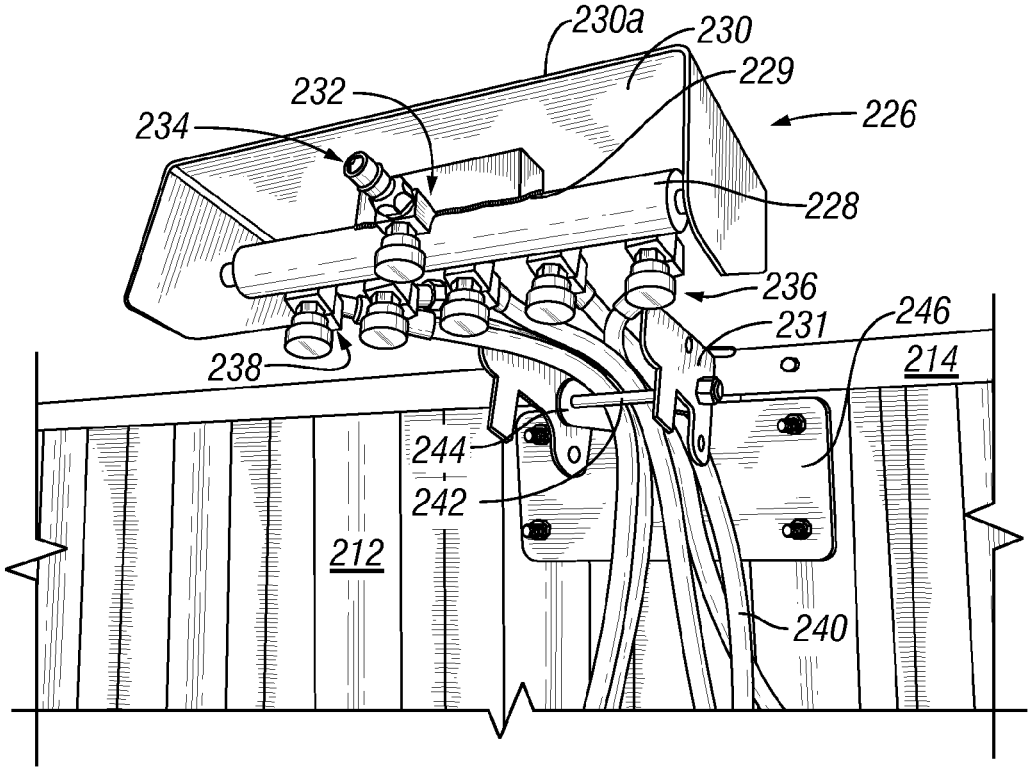
FIG. 5 is a detailed view of the manifold assembly of FIG. 2 pivoted upwardly into an intermediate position.

The manifold shield 230 will be secured in the lower position of FIG. 4 when the shoring system is being moved into or out of an excavation, or otherwise being transported. A retaining pin 231*b* is employed for this purpose, and is slidable through the aligned holes in the flanged portion 231 of the manifold shield 230 and holes in the flanged portion 244 of the side wall bracket 246, to secure the shield 230 to the side wall bracket 246.

Figure 6:
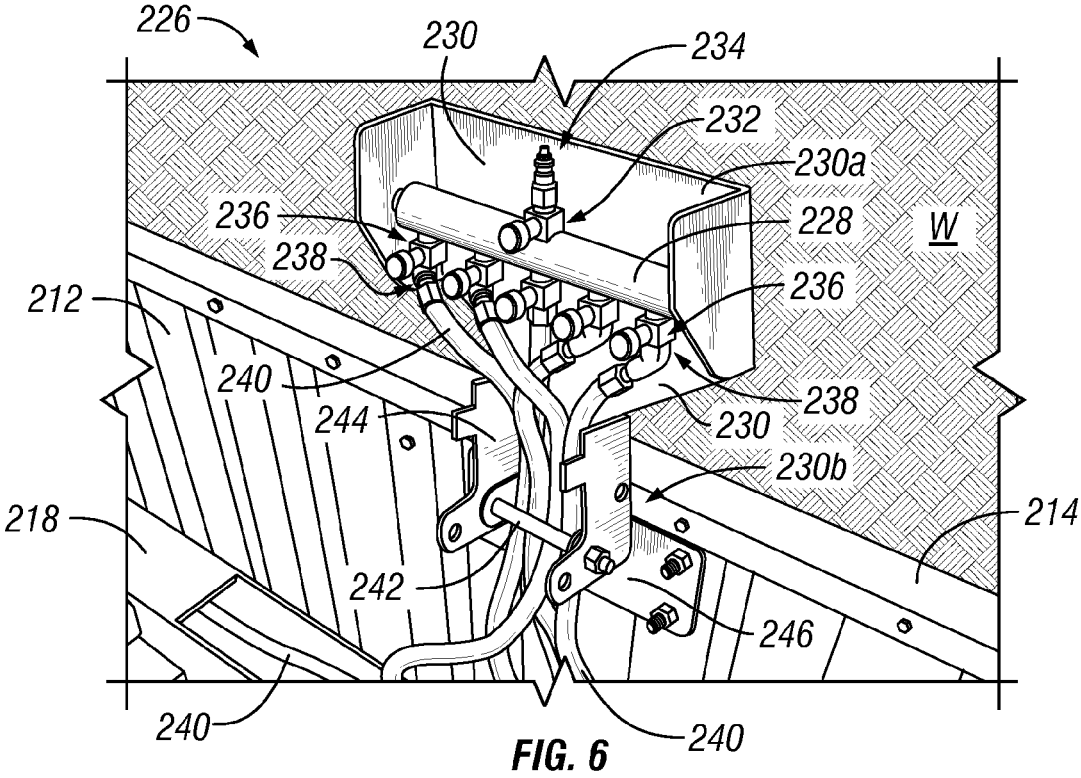
FIG. 6 is a detailed view of the manifold assembly of FIG. 2 in an upper, exposed position wherein the manifold is exposed.

In FIG. 6, the manifold assembly 226 is shown pivoted to an upright position adjacent a wall W of an excavation when the shoring system is disposed beneath the surface (not shown in FIG. 6). In this position, the quick-connect coupling 234 is exposed for easy access, connection, and disconnection to a hydraulic supply hose (not shown).

Figure 7:
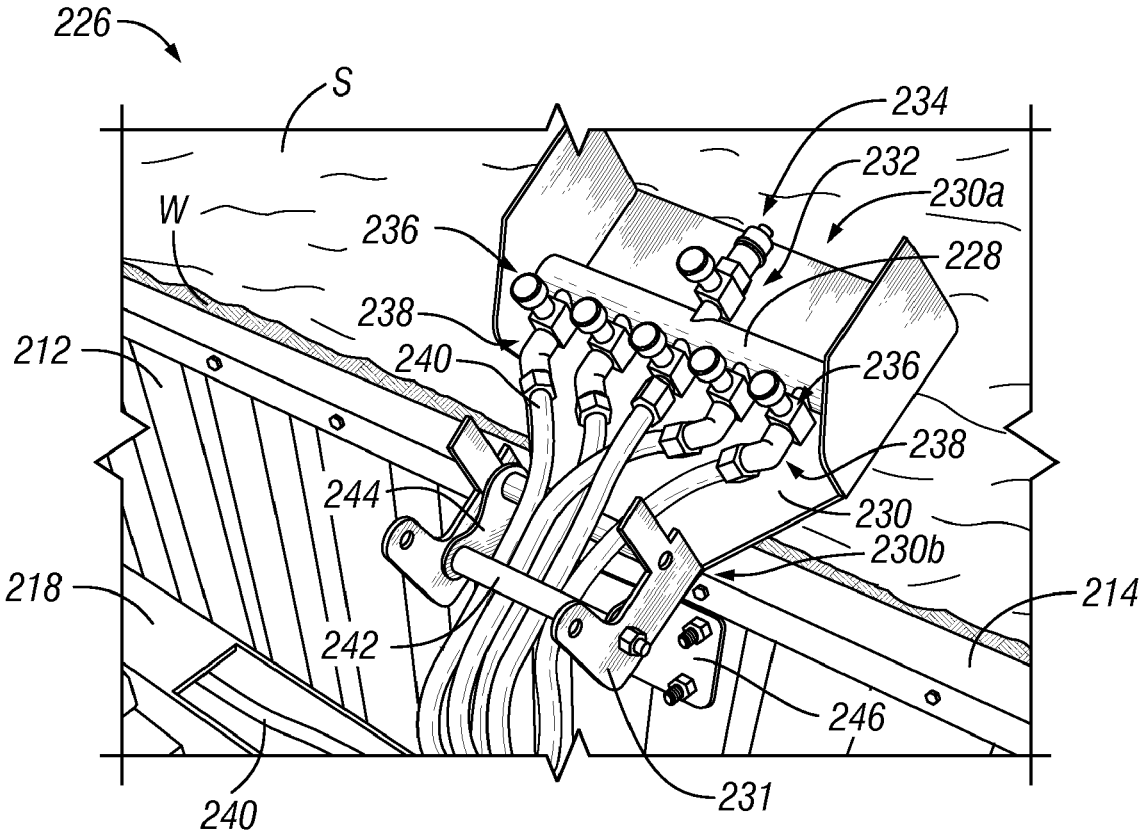
FIG. 7 is a detailed view of the manifold assembly of FIG. 2 pivoted beyond the position of FIG. 6 to another exposed position.

In FIG. 7, the manifold assembly 226 is further pivoted to an upper, back-tilted position (slightly over-rotated compared to FIG. 6) when the cap elements 214 of the shoring system are disposed substantially flush with the surface S. In this position, the quick-connect coupling 234 and other components of the manifold assembly 226 are further exposed for connection, disconnection, maintenance, and so forth.

The manifold shield 230 is substantially Y-shaped, having a wider portion at or near one end 230*a* and the narrower flanged portion 231 at or near another end 230*b*. The cylindrical manifold body 228 is pipe-like, and is carried across the wider portion 230*a* of the manifold shield 230, by way of welding (weld bead 229 depicted in FIG. 5) or bolting. The hydraulic hoses 240 are routed through the narrow flanged portion 231 of the manifold shield 230. The mounting bolt 242 cooperates with the narrow flanged portion 231 of the manifold shield 228 to closely group the hydraulic hoses and route them from the manifold assembly 226 to the respective hydraulic jacks 250. Thus, a hose guide is formed between the mounting bolt 242 and the flanged portion 231.

The movable manifold assembly 226 according to the present invention is easier to operate compared to the limited utility of conventional manifold assemblies. By mounting the manifold body 228 to one side of a manifold shield 230, and pivotally mounting the shield to an inner face of one of the shoring system side walls 212, the manifold body is selectively positionable in the shielded position, wherein the manifold is at least partially covered and protected by the manifold shield for normal use. The manifold is then moveable to the exposed position, wherein the manifold body is rotated above the cap element 214 for easy access. Accordingly, the manifold body may be quickly and conveniently moved to an elevated position such as for connecting and disconnecting a hydraulic supply hose to the manifold body 228 and the shut-off inlet valve 232, by way of the quick-connect coupling 234, and for similarly connecting and disconnecting the hydraulic discharge hoses 240 to the manifold body.

Figure 8:
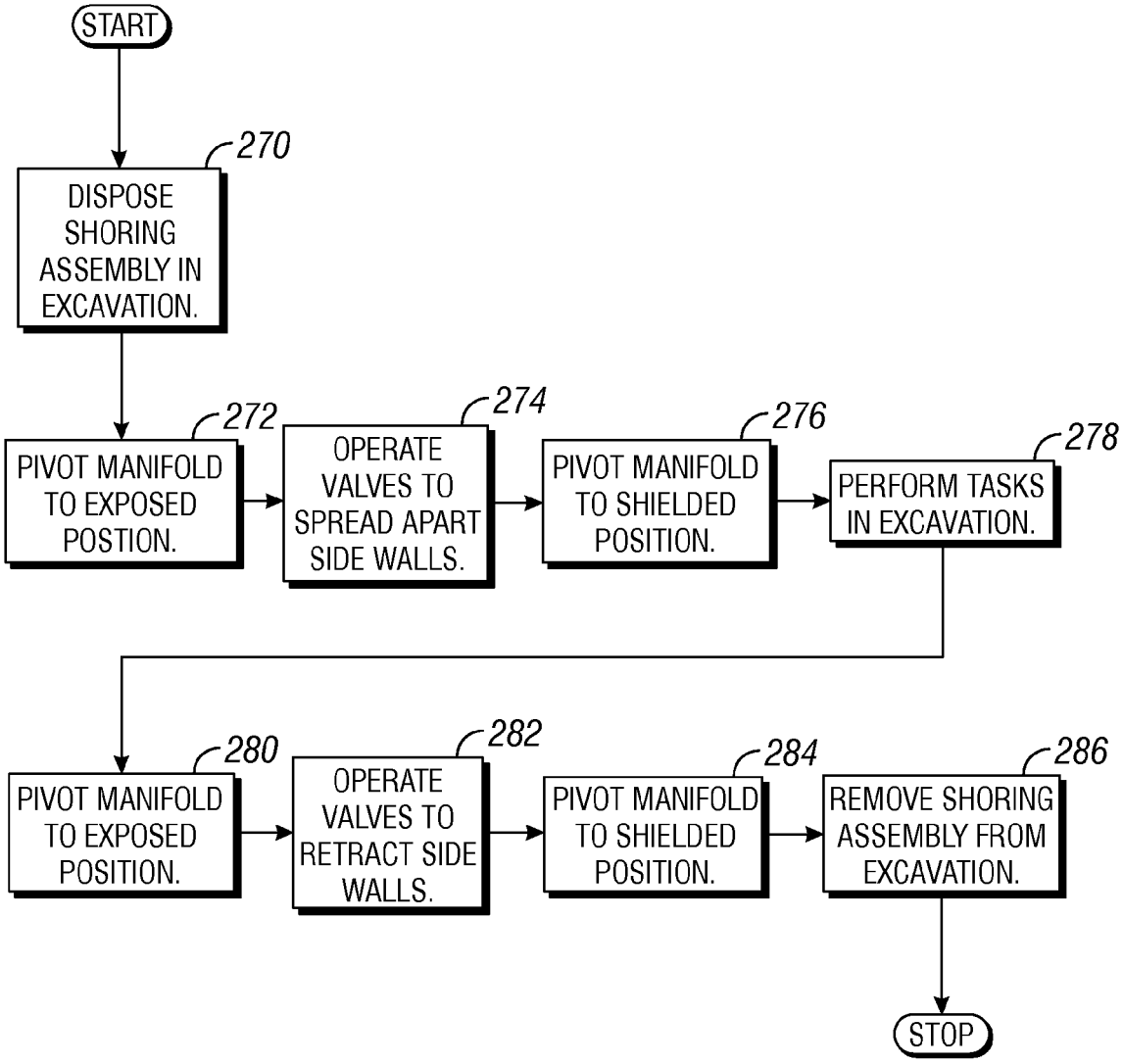
FIG. 8 is a flowchart of a shoring method according to one embodiment of the present invention.

FIG. 8 is a flowchart of one embodiment of a shoring method according to the present invention. In step 270, a shoring assembly, such as the shoring assembly 210 of FIG. 2, is disposed within an excavation. In step 272, a worker may pivot a manifold to an exposed position to access controls, valves, and other manifold components. The worker may connect hydraulic lines to any number of inlet and outlet ports included with the manifold. Valves and other fluid controls may also be accessible when the manifold is in the exposed position. In step 274, the worker may spread apart side walls of the shoring assembly by operating the valves disposed on the manifold to control fluid pressure to hydraulic actuators. With the side walls of the shoring system fully engaged with earthen side wall of the excavation, the worker may then pivot the manifold to the shielded position in step 276. With the fluid lines, fluid controls, and other manifold components shielded, workers may then safely perform routine tasks in the excavation, such as such as below ground repairs, maintenance, or installations in step 278. When the workers have finished their tasks, one of the workers may again pivot the manifold to the exposed position in step 280. The worker may operate the valves to retract the side walls of the shoring system in step 282. While the manifold is still in the exposed position of step 280, the worker may also disconnect the fluid lines and perform other steps to prepare to remove the shoring system from the excavation. The worker may then pivot the manifold back to the shielded position in step 284. In step 286, the worker may remove the shoring system from the excavation or move it to another location within the excavation.

The terms "comprising," "including," and "having," as used in the claims and specification herein, shall be considered as indicating an open group that may include other elements not specified. The terms "a," "an," and the singular forms of words shall be taken to include the plural form of the same words, such that the terms mean that one or more of something is provided. The term "one" or "single" may be used to indicate that one and only one of something is intended. Similarly, other specific integer values, such as "two," may be used when a specific number of things is intended. The terms "preferably," "preferred," "prefer," "optionally," "may," and similar terms are used to indicate that an item, condition or step being referred to is an optional (not required) feature of the invention.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A shoring system comprising:

first and second opposing side walls;

a plurality of hydraulic jacks connected between the side walls for selectively adjusting a spacing between the side walls;

a manifold including a hydraulic inlet for receiving hydraulic fluid from a fluid source and a plurality of hydraulic outlets for distributing the hydraulic fluid to the plurality of hydraulic jacks, the manifold being pivotally secured to the first side wall and pivotally moveable between a shielded position and an exposed position; and a manifold shield disposed on the manifold for at least partially shielding the manifold when the manifold is in the shielded position.

2. The shoring system of claim 1, wherein the manifold shield is pivotally secured to the first side wall for carrying the manifold between the shielded position and the exposed position.

3. The shoring system of claim 1, further comprising:

one or more hydraulic hoses connected to the one or more hydraulic outlets for delivering hydraulic fluid from the manifold to one or more hydraulic jacks; and a hose guide disposed on the manifold shield, the hose guide including an opening through which the one or more hydraulic hoses are routed, for closely grouping the hydraulic hoses.

4. The shoring system of claim 3, further comprising:

a bracket having a flanged portion;

a pin carried across the flanged portion of the bracket; and wherein the hoses are routed between the bracket and the pin.

5. The shoring system of claim 3, wherein the hose guide is sized such that the grouped hydraulic hoses together occupy at least half of the opening.

6. The shoring system of claim 1, wherein the manifold shield is substantially Y-shaped, having a wider portion at one end and a narrower flanged portion at another end, and the manifold has a cylindrical body and is carried across the wider portion of the manifold shield, with the hydraulic hoses routed through the narrower flanged portion of the manifold shield.

7. A shoring system, comprising:

first and second opposing side walls;

a plurality of hydraulic jacks connected between the side walls for adjusting the relative spacing between the side walls;

a pair of rails connected in parallel across an inner face of each of the opposing side walls;

a plurality of first pads carried in each of the rails of the first side wall and a plurality of second pads carried in each of the rails of the second side wall, wherein the plurality of hydraulic jacks are each operatively connected between one of the first pads and one of the second pads;

a manifold having a hydraulic inlet for receiving hydraulic fluid and a plurality of hydraulic outlets for distributing hydraulic fluid to the plurality of hydraulic jacks; and a manifold shield pivotally secured to the first side wall for carrying the manifold between a shielded position wherein the manifold is covered by the shield, and an exposed position wherein the manifold is exposed.

8. The shoring system of claim 7, wherein each of the hydraulic jacks comprises:

a hydraulic cylinder operatively connected to one of the first pads;

a hydraulic piston axial moveable within the hydraulic cylinder; and a piston rod for transferring force to or from the hydraulic piston, the piston rod being operatively connected to one of the second pads.

9. The shoring system of claim 7, further comprising a valve at the hydraulic inlet for controlling the flow of hydraulic fluid into the manifold.

10. The shoring system of claim 7, further comprising a valve at each hydraulic outlet for controlling the flow of hydraulic fluid from the manifold to the plurality of hydraulic jacks.

11. The shoring system of claim 10, further comprising a plurality of hydraulic hoses, with one of the hydraulic hoses connected to each outlet valve, for delivering hydraulic fluid from the manifold to the respective hydraulic jacks.

12. The shoring system of claim 11, wherein the manifold shield is substantially Y-shaped, having a wider portion at one end and a narrower flanged portion at another end, the manifold is cylindrical and is carried across the wider portion of the manifold shield, and the hydraulic hoses are routed through the narrow flanged portion of the manifold shield.

13. The shoring system of claim 12, wherein the manifold shield is pivotally mounted to an inner face of one of the side walls using a pin carried across a flanged portion of a bracket bolted to the inner face of the one side wall, the pin cooperating with the narrow flanged portion of the manifold shield to route the hydraulic hoses between the narrow flanged portion and the pin.

14. A method of shoring, comprising:

pivoting a manifold secured to a first side wall from a shielded position, wherein the manifold is shielded, to an exposed position, wherein the manifold is accessible to a user;

controlling fluid flow through the manifold to actuate a plurality of hydraulic jacks connected between the first side wall and an opposing second side wall, to adjust a spacing between the first and second side walls; and shielding the manifold by pivoting the manifold from the exposed position to the shielded position.

15. The method of claim 14, wherein the step of shielding the manifold further comprises positioning the manifold between a shield and the first wall.

16. The method of claim 14, further comprising retaining a plurality of hoses between a pin and bracket used to pivotally secure the manifold to the first side wall.

* * * * *